US006098508A

United States Patent [19]

Battistone

[11] Patent Number: 6,098,508

[45] Date of Patent: Aug. 8, 2000

[54] PLIERS

[75] Inventor: Nicola Battistone, Richmond Heights, Ohio

[73] Assignee: Meritool Corporation, Chagrin Falls, Ohio

[21] Appl. No.: 09/130,431

[22] Filed: Aug. 6, 1998

Related U.S. Application Data

[60] Provisional application No. 60/054,825, Aug. 7, 1997.

[51] Int. Cl.[7] ..... B25B 7/12

[52] U.S. Cl. ..... 81/416; 81/387

[58] Field of Search ..... 81/387, 393, 394, 81/385, 405, 407, 408, 411, 416, 418

[56] References Cited

U.S. PATENT DOCUMENTS

| | | | |
|---|---|---|---|
| 611,537 | 9/1898 | Ward . | |
| 644,825 | 3/1900 | Jensen . | |
| 1,772,224 | 8/1930 | Peterson . | |
| 1,873,805 | 8/1932 | Allan . | |
| 2,799,191 | 7/1957 | Barnes . | |
| 2,854,878 | 10/1958 | Mead . | |
| 3,130,616 | 4/1964 | Miller | 81/417 X |
| 3,241,814 | 3/1966 | Forte . | |
| 3,685,097 | 8/1972 | Scott et al. . | |
| 4,635,510 | 1/1987 | Box | 81/417 X |
| 5,060,543 | 10/1991 | Warheit . | |
| 5,176,048 | 1/1993 | Jore et al. . | |
| 5,209,143 | 5/1993 | Sweet . | |
| 5,291,810 | 3/1994 | Lins | 81/393 X |
| 5,427,004 | 6/1995 | Monaco . | |

FOREIGN PATENT DOCUMENTS

| | | | |
|---|---|---|---|
| 0 448 785 A2 | 10/1991 | Germany | 81/416 |

*Primary Examiner*—David A. Scherbel
*Assistant Examiner*—Anthony Ojini
*Attorney, Agent, or Firm*—Vickers, Daniels & Young

[57] ABSTRACT

An improved pliers having a first and second member. The first member includes a jaw operatively connected to a first handle, and the second member includes a second jaw operatively connected to a second handle. A slot is located in one of the members between the jaw and the handle. A pin in the other member extends into the slot and is secured therein to hold the members together while permitting relative motion between them. The slot may have different shapes but must be long and wide enough to allow the pin unrestricted motion. A projection extends from one of the members and engages a pivot area which may be a surface or a notch on the other member. In two embodiments of this invention, two pivot notches are used to give two different ranges of motion to the jaws. Different shapes of jaws may be used for specialized purposes, such as, opening pipe clamps or removing oil filters. The projection and pivot notches may be placed at different locations between the pin and the jaws to give a different mechanical advantages.

16 Claims, 4 Drawing Sheets

PLIERS

This application claims the benefit of U.S. Provisional Application Ser. No. 60/054,825, filed Aug. 7, 1997.

BACKGROUND OF THE INVENTION

Conventional pliers use a moving pivot between the members. That is, a projection extends from one of the members between the jaw and the handle. There is a complimentary slot on the other member in which the projection moves. Because the projection acts both as the pivot point and as the variable adjustment, it has a tendency to slip when in use. This is extremely annoying and can be dangerous at times.

Prior art devices, such as, U.S. Pat. No. 644,825 to P. Jensen, uses various pivots and handles. In the Jensen patent, three handles are used along with two pivot points. There is no movable pin in a slot.

In U.S. Pat. No. 5,176,048 to Jore et al., a pin and slot arrangement is used, but there is no projection and pivot surface about which the projection pivots. Thus, the jaws have a narrowed range of motion of its opening relative to this invention. Both above-noted patents are incorporated herein by reference.

This invention has the advantage of providing a wide variable range of movement of the jaws by the combination of a projection that cams about one ore more pivot surfaces and a pin movably secured in a slot. The projection extends from one member and abuts against a pivot area of the other member in a fashion which allows the members to move relative to one another in a scissors fashion. The location of the projection and pivot surface relative to the jaws and handles of the pliers determines the mechanical advantage thereof. The pin extends from one member through a slot in the other member and has a head or other device for holding it in the slot while permitting relative motion of the members. This combination gives secure movement of the members while allowing a wide range of travel of the jaws. Alternate embodiments of this invention utilize a plurality of pivot areas or pivot notches to engage the projection. Differently-shaped jaws may be used to grasp specialized items.

SUMMARY OF THE INVENTION

An improved pliers having a first member having a jaw operatively connected to a first handle and a second member having a jaw operatively connected to a second handle. A slot in one of the members between the jaw and the handle receives a pin which is attached to the other member between the jaw and handle. The pin extends through the slot and is secured therein to hold the first and second members together while permitting relative motion therebetween. A projection extends from one of the members and abuts against a pivot area of the other member so that as the handles move toward and away from each other, the pin moves in the slot as the projection pivots about the pivot area and gives the jaws a wide range of motion.

DETAILED DESCRIPTION OF THE DRAWINGS

Figure 1:
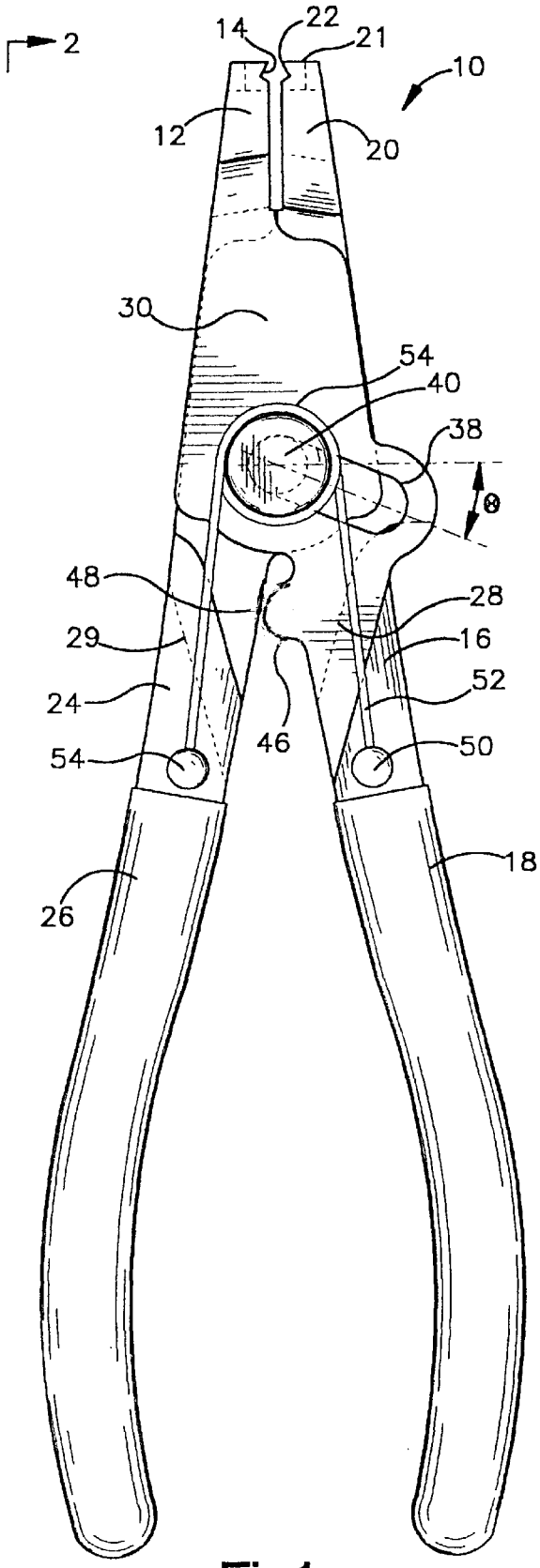
FIG. 1 is a top view of the pliers of this invention.

The improved pliers 10 of the invention (FIGS. 1 and 2) include a first member 11 having a first jaw 12 having a first groove 14. A first handle 16 is partially covered by a first handle grip 18 and is rounded to fit a user's hand. The first handle grip 18 is optional but convenient and more comfortable for the user. It normally is made of any one of many thermoplastic materials used for this purpose such as polyvinyl. The first member 11 also has a first handle 16 which is operatively connected to or integral with the first jaw 12.

A second member 19 has a second jaw 20 having a second groove 22 which is operatively connected to or integral with a second handle 24. The term "operatively connected to" includes these methods of attachment and may include a transition area or any other connections known in the art for all the embodiments. A second optional grip 26 partially covers the second handle 24 and is the mirror image of the first grip 18 and made of the same material.

A transition area 28 in the thickness and/or curvature of the first handle 16 elevates a base portion 30 (FIG. 2) of the first jaw 12 so that it overlaps a similar base portion 32 of the second jaw 20. A transition area 29 allows the base portion 32 to move in a complementary fashion so that the overlapping base portions 30 and 32 meet and part in a scissor-like fashion. This transition area is one way of many that allows a jaw to be operatively connected to a handle. The transition area is generally part of the handle.

Figure 2:
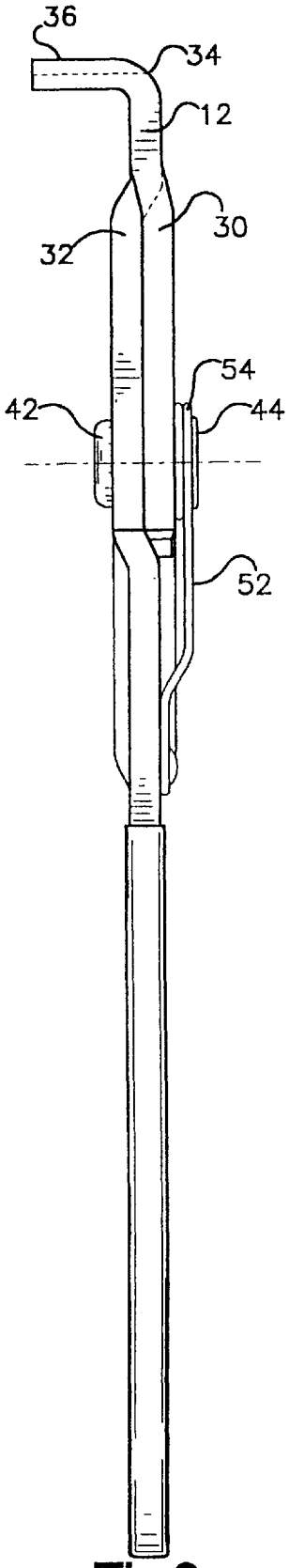
FIG. 2 is a side elevational view of the pliers of this invention.

The jaws in FIG. 1 directly abut and move away from each other. The jaws of FIGS. 1 and 2 also have a bend to form a right angle portion 36 which is designed to grasp a hose, pipe or tube clamp. The jaws, however, may have any configuration from simple abutting faces to one of the many specialty configurations for different purposes.

The base portion 32 of the first jaw 12 has a passage slot 38 (FIG. 1) cut, molded or otherwise formed in it. A jaw pin or simply a pin 40 having ends 42 and 44 is sized and mounted in the second base portion 32 so that it may move freely in the passage slot 38.

A projection 46 extends from the side of the first handle 16 facing the second handle 24. It is shaped and sized so that it engages a pivot area or surface 48 on the inside portion of second handle 24. The shape, size and placement of the projection 46, pivot surface 48, passage slot 38 and jaw pin 40 may be varied to cause relative changes in opening and closing ratios of the movement of the jaws 12 and 20 to the handles 16 and 24. In this manner, relatively larger changes in the jaw opening can be made with relatively small movements of the handles than in the prior art. Thus, much larger items can be grasped comfortably and securely with these pliers than those in the prior art. Many possible combinations exist, but one size that has been found useful includes pliers having a total length of about 8.5 inches. The jaw pin 40 is about 2.25 inches from the end 21 of the second jaw 20, and the passage slot 38 is about one inch long and is at an angle equal to about 230 from an axis perpendicular to the central axis of the pliers. The slot length and angle will vary according to the desired performance of the tool. The ends of passage slot 38 are rounded but are not critical to the function. The projection 48 is located about three inches from the top of the jaws. This dimension will also vary with different sized pliers.

A first spring rivet 50 fastens one end of spring wire 52 to the first handle 16. The spring wire 52 wraps and forms a loop 54 (FIGS. 1 and 2) around jaw pin 40. The other end of the spring wire is attached to the second handle 24 by a second spring rivet 54. The spring wire 52 is biased to hold the first and second handles 16 and 24 in a normally open position (best shown in FIG. 4). In this position, the projection 46 is slightly spaced from the handle 24. The use of terms pin and rivet as used herein may mean any appropriate fastener such as screws, nuts and bolts, pins, rivets, integral extensions and the like.

Figure 3:
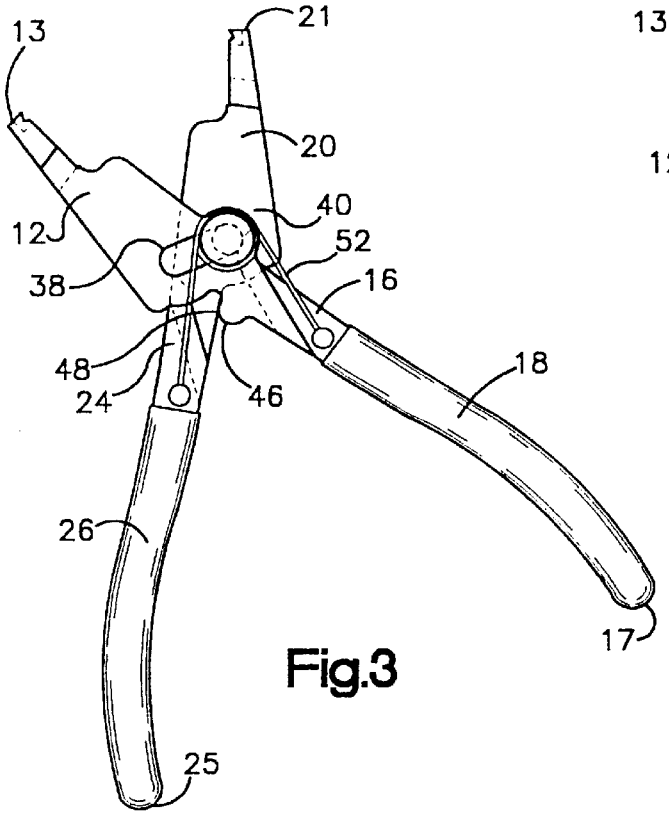
FIGS. 3–5 are top views illustrating the relative movement of the jaws and handles of the improved pliers.
Figure 4:
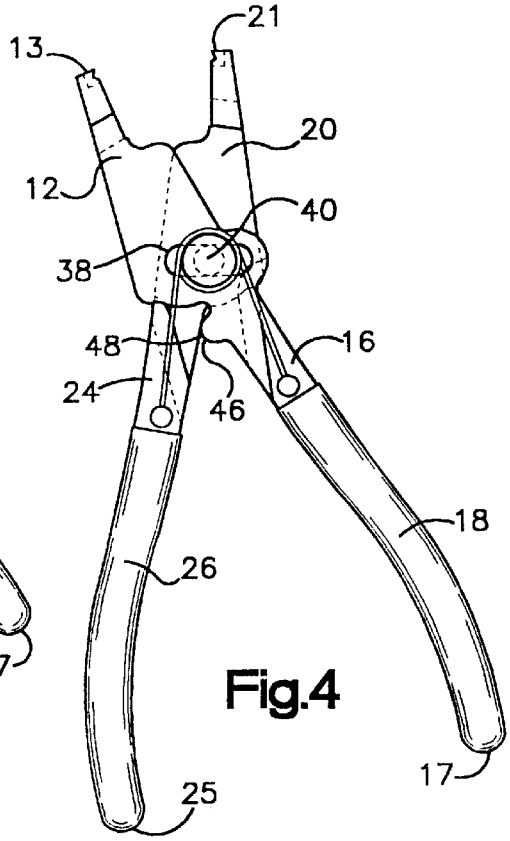
Figure 5:
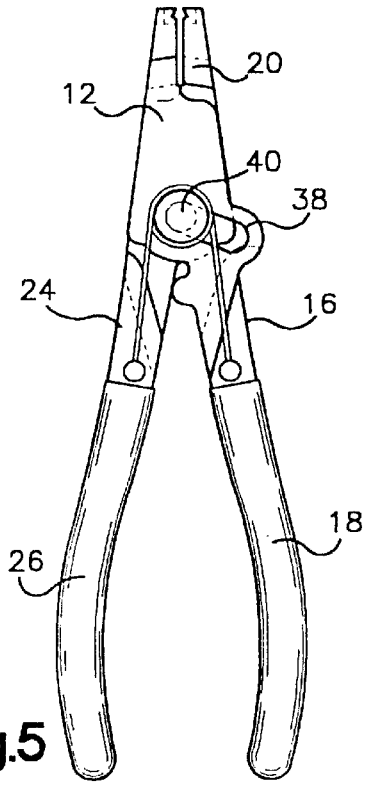

FIGS. 3–5 show the operation and the advantages of this invention. FIG. 3 illustrates the position of the jaws 12 and 20 in their most open arrangement for a given position of handles 16 and 24. This occurs when the jaw pin is the farthest to the right in the passage slot 38. As the handles 16 and 24 converge (FIG. 4), the projection 46 engages the pivot surface 48 and jaw pin 40 moves part way to the left in passage slot 38. This invention provides greater movement of the jaws for a given handle movement because it provides a variable mechanical advantage. This larger range of motion is highly advantageous when grasping large or widely spread elements such as pipe, tube or hose clamps, large nuts or irregular-shaped objects.

The pliers are shown in the closed position in FIG. 5. The jaws 12 and 20 are abutting, and the jaw pin 40 is positioned at the far left of the passage slot 38. Note that in FIGS. 3 through 5, the handles may be held comfortably in a person's hand. In this example, the widest part of the handles are spaced about 4.5 inches in FIG. 3 to 2.25 inches in FIG. 5 while the ends 13 and 21 of the jaws range from 1.8 inches to closure.

The variations of jaw opening to handle opening is greater in this invention than conventional pliers for a single position. In a conventional single pivot tool, the ratio of the distance from the pivot to the center of pressure of the handle to the distance from the pivot to the tip would be approximately 2 to 1. In this embodiment, the ratio of lengths (which is also the mechanical advantage) automatically varies from 1.45 to 1 in the open position to 1 to 1 in the closed position. For application of a hose clamp plier, the low mechanical advantage poses no problem because the maximum handle force required is less than 50 pounds. In a hand tool, three parameters are important.

1. Handle span when fully open.
2. Handle span when closed.
3. Handle force required.

Parameter 1 must not exceed a value which can be comfortably attained by the average hand.

Parameter 2 must not be less than a value which yields maximum grip force by the average hand.

Parameter 3 should not exceed 50 lb. for comfort of the user. (Average male grip strength varies from 80 to 120 lb. maximum).

Thus, a 1 to 1 mechanical advantage would not be satisfactory if the tip force required is 100 lb.

The invention illustrated is best suited for relatively low force requirements at the tip. It is ideal for this hose clamp application. However, it would be a simple matter to change the ratio of lengths and, thus, the mechanical advantage to obtain greater forces.

Conventional pliers usually have two positions for the relationship of the movement of the jaws to the handles. This is accomplished by having two notches or positions in the slot in which the jaw pin is located. The disadvantage of this structure is that the handles are often too far apart or too close together for proper leverage for a given jaw spacing. Moreover, conventional pliers pivot at the pin rather than at a separate pivot point which can provide additional jaw separation. The conventional rotation pin may also jump from one notch to the other in the slot at annoying and inconvenient times. This invention uses a single stable pivot and the entire slot to gain the advantage of larger variations of the jaw opening for different handle movements.

FIGS. 6–9 illustrate an alternate embodiment of this invention for pliers that provide a very large range of jaw openings and a high strength rotational structure. A first member 59 having a jaw 60 is operatively connected to or integral with a first handle 62. A jaw pin 64 with a head 65 extends from one side of the first jaw 60. The other end of the jaw pin 64 is fastened to or extends through the first jaw and is fastened thereto in a secure manner. A projection 66 also extends from and is connected to one side of the first jaw 60.

A second member 67 having a second jaw 68 which is operatively connected to or integral with a second handle 70. A passage slot 72 is formed in the second jaw 68. The passage slot 72 includes a first arc 74 and a second arc 76 connected by a notch 78. The passage slot 72 is positioned, sized and shaped to allow the jaw pin 64 to move through it easily without binding and without falling out of the slot 72. The jaws and handles are illustrated as curved but may be any known shape to grasp desired items comfortably.

A pivot area 79 includes a first pivot notch 80 and a second pivot notch 82 are located along one side or edge of the second jaw 68. The notches 80 and 82 are sized and designed to engage and pivot about the projection 66. It should be understood that some or all of the pins, notches and slots may be on either jaw. It is only important that they interact with each other as described.

Figure 6:
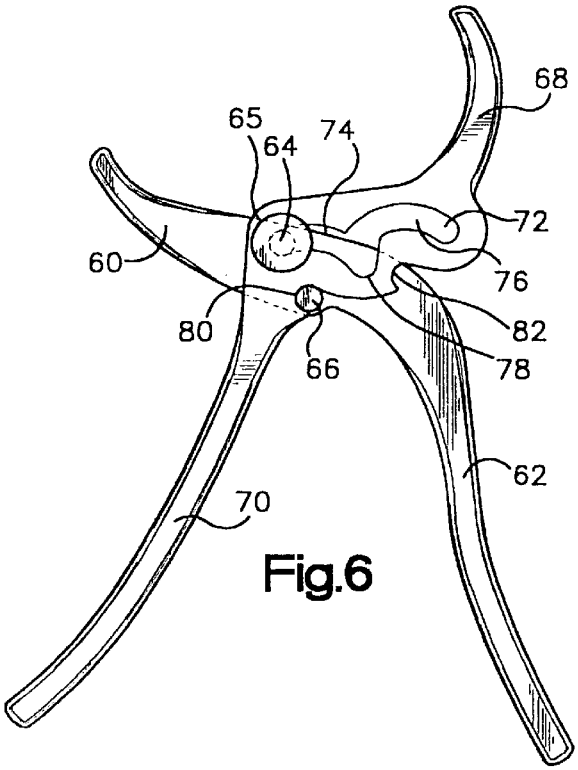
FIGS. 6–9 are top plan views of an alternate embodiment.
Figure 7:
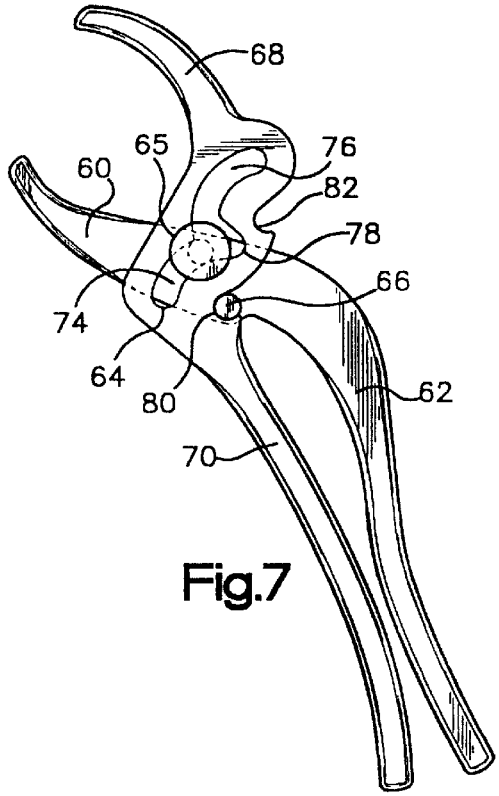

FIGS. 6 and 7 illustrate the movement of the jaws and handles when the projection 66 is engaged with the first notch 80. In this position, the jaws have their opening at their widest position and may be used to grasp relatively large obstacles. If the jaws are curved as shown, they could grasp and hold an oil filter or other cylindrical object. The jaws, however, could have conventional abutting faces to hold or squeeze objects. As the handles 62 and 70 converge on each other (FIG. 7), the projection 66 acts as a pivot for the second jaw 68 by means of the first notch 80. As this occurs the jaw pin 64 moves in the first arc 74 toward the notch 78.

Figure 8:
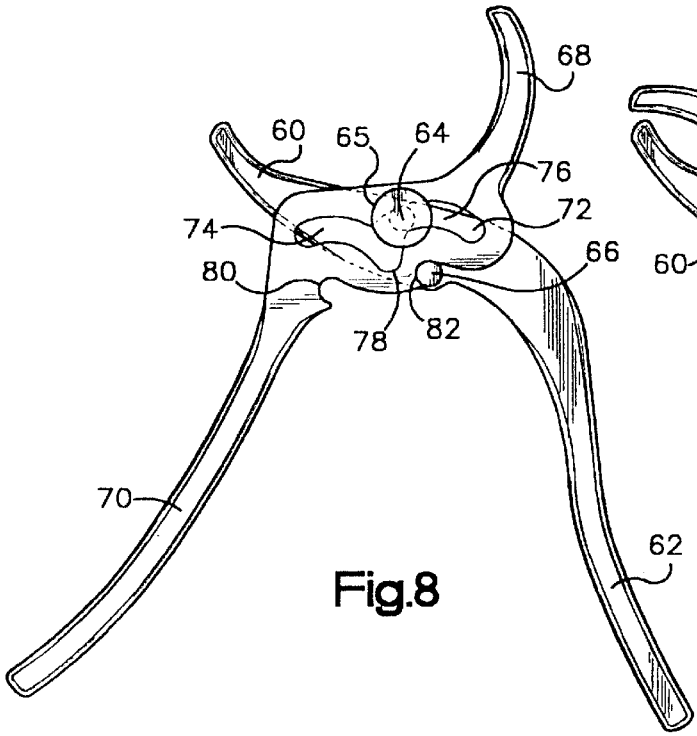
Figure 9:
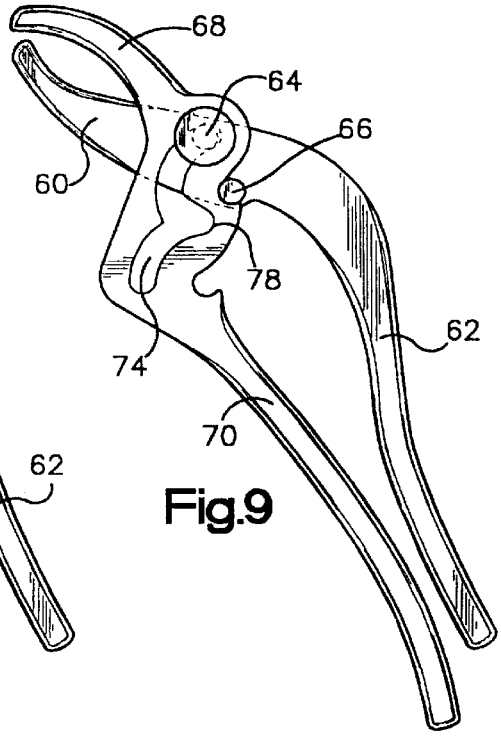

FIGS. 8 and 9 illustrate the same embodiment differing only in that projection 66 engages the second notch 82 instead of the first notch 80. In this position, the jaw pin 64 moves in the second arc 76. The opening between the jaws 60 and 68 is smaller in this arrangement for every given position of the handles than in FIGS. 6 and 7. Obviously, the second notch 82 is used when the object to be grasped is smaller.

One major advantage of this embodiment is that the jaws pivot about the projection 66. Thus, the strength or holding ability of the pliers depends on the shear strength of the projection 66 and notch 80 or 82. The shear strength of steel is very high depending on the material used and the diameter of the projection 66. It would normally be much much higher than the strength of the person using the improved pliers.

Another major advantage of these pliers is the security with which they grasp items. Because the notches 80 and 82 have an arc of about 180°, to engage the projection 66, the jaws do not slip out of place relative to each other. The prior art has variable width jaws which use teeth in the slot to engage a pivot pin. The pin would often jump from tooth to tooth and make the pliers difficult and frustrating to use. The prior art also did not use a separate projection 66 as the point of rotation of the handles. Accordingly, the movement and grasp of prior art pliers was not only less reliable but the connection was weaker.

Variation of the placement of the projection that acts as a pivot in all embodiments discussed herein can be used to vary the relative openings of the jaws to the movement of the handles. The placement of the projections may vary widely but one embodiment of FIGS. 6–9 that works well has an overall length of 9.5 inches. The handles are about six inches from their ends to the projection 66 or first notch. The end of the first jaw 60 is about three inches from the projection 66. It is about 3.75 inches from the first notch 80 to the end of the second jaw 68. The pin 64 is about 2.5 inches from the end of the jaw on which it is mounted. Other dimensions and variations will be obvious to those skilled in the art.

Figure 10:
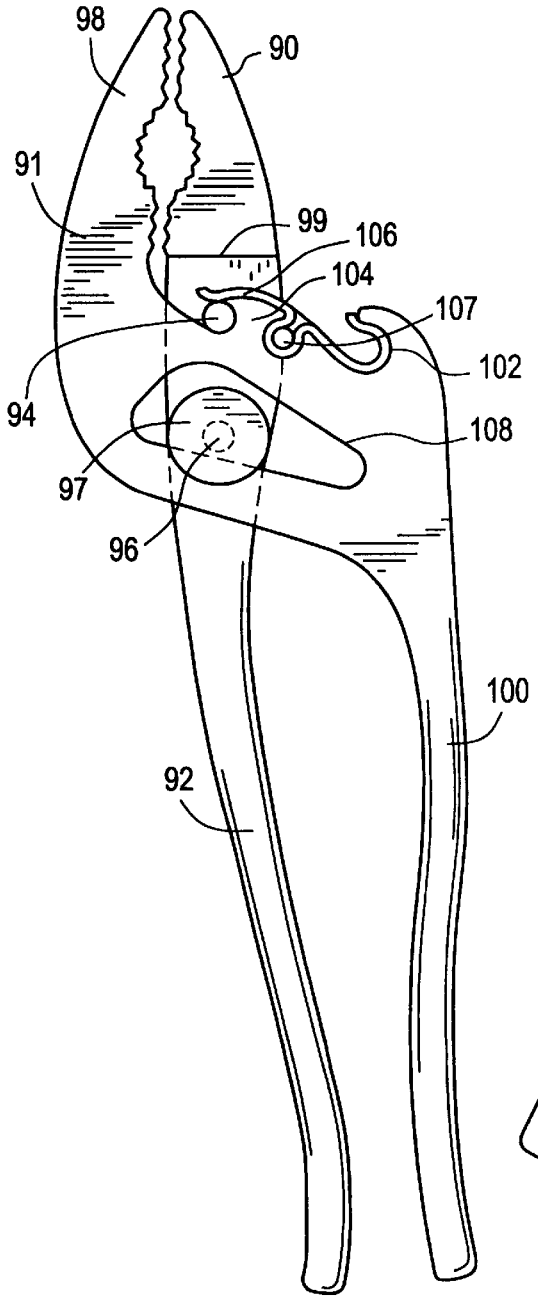
FIGS. 10 and 11 are top plan views of another alternate embodiment.
Figure 11:
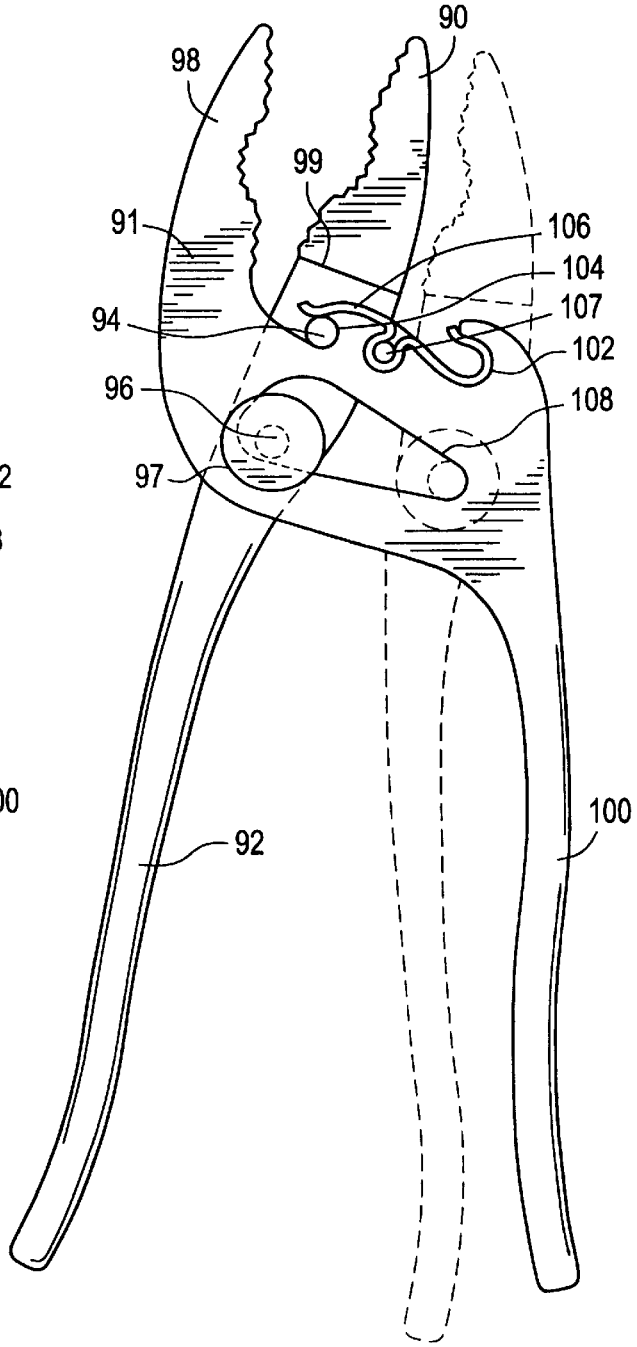

FIGS. 10 and 11 show an alternate embodiment of FIGS. 6–9. The improved pliers of FIGS. 10 and 11 have their pivots closer to the ends of the jaws to create a greater mechanical advantage (e.g. grasping force) while still providing a very large range of movement of the jaws. In particular, a first member 89 having a jaw 90 which is operatively connected to or integral with a first handle 92. A projection 94 is located at the transition area between the first jaw 90 and the first handle 92. A jaw pin 96 or retainer has a head 97 on one end. A second head or retainer on the other end of the projection would be necessary to hold the parts together.

A second member 97 having a jaw 98 which is operatively connected to or integral with a second handle 100. A pivot area 101 includes a first pivot notch 102 and a second pivot notch 104 which are located at the transition area between the second jaw 98 and the second handle 100. A spring clip 106 conforms to part of the pivot notch 102 and second pivot notch 104 in such a manner to grasp the projection 94 so that it does not slip out of the notches unintentionally. A spring clip retainer 107 holds the spring clip 106 in place. There could be many different designs of a retainer, or the notches themselves could be slightly over 180° to hold the projection 94 in place while still allowing it to move in and out. The spring clip 106 is optional, but the clip 106 could also be used on the other embodiments described herein.

A slot or opening 108 is formed in the second handle 100 and allows the jaw pin 96 to move within it. The slot 108 is generally triangular so that the jaw pin 96 may move in different arcs without binding and so that the projection 94 may be moved to the different pivot notches. The shape of the slot 108 is not critical, but it must be large enough to allow the jaw pin 96 to move to all of its positions without binding. This same type of slot could be used in other pliers, e.g. FIG. 6, shown in the application.

FIG. 11 shows the position of the various parts as the handles and jaws separate when the projection 94 is in the pivot notch 104. In this position, the jaws would move from being closed to a first open position. When the projection 94 is in the first pivot notch 102, shown dotted in FIG. 10, the jaws 90 and 98 would open from generally the first open position to a significantly greater second open position. The first pivot notch 102 is obviously used to grasp larger objects. The range of movement of the jaws can be changed by the size and shape of slot 108 and the positions of the pivot notches 102 and 104. The jaws 90 and 98 are thinned below the lines 91 and 99 to allow them to come together in a scissors-like fashion. Again, the shape of the jaws and handles can be varied to meet any special requirements.

Many dimensions would work. In one successful embodiment, the projection is about 2" from the end of the first jaw 92. The first pivot notch is about 3" from the end of the second jaw 98, and the second pivot notch is about 2.5" away from it. The slot is about 2.0"×1.5"×1.0" and has its general center about 3.5" from the end of the second jaw 98. The jaw pin 96 is about 3.5" from the end of the end of the first jaw 90. The handles are about 7" long. The lengths and ratios can be varied as desired.

The advantages of the pliers of FIGS. 10 and 11 are very similar to those for the other pliers. A larger range of motion with greater strength and security of the relative positions is provided than was previously known in the prior art. In addition, the pliers shown in FIGS. 10 and 11 have a greater mechanical advantage resulting in larger grasping forces since the projection or pivot pin 94 is closer to the jaws 90 and 98 than the prior art. That is, the ratio of the distance from the jaws 90 and 98 to the projection 94 to the distance from the projection 94 to the handles 92 and 100 is less than the prior art. Known basic mechanical principles can show that this gives greater holding forces at the jaws.

Although particular embodiments of the invention have been described in detail, it will be understood that the invention is not limited correspondingly in scope, but includes all changes and modifications coming within the spirit and terms of the claims appended hereto.

What is claimed is:

1. Pliers comprising:

a first member having a first jaw operatively connected to a first handle;

a second member having a second jaw operatively connected to a second handle;

a slot in the first member between the first jaw and the first handle;

a pin on the second member between the second jaw and the second handle; the pin extending through the slot and being secured therein to hold the first and second members together while permitting relative motion therebetween;

a projection extending from one of the first and second members;

a pivot area on the other of the first and second members which is engaged by the projection as the handles move toward and away from each other so that the pin moves in the slot as the one of the first and second members pivots about the projection.

2. The pliers of claim 1 wherein the projection extends from the side of the one of the first and second members and engages the side of the other of the first and second members between the pin and the first and second handles.

3. The pliers of claim 2 wherein the pin is a jaw pin having ends which are large enough to hold it in the slot which is at an angle of about 23° from an axis perpendicular to the central axis of the pliers.

4. The pliers of claim 2 wherein a spring wire is attached to the first and second handles and is wound about the pin to hold the pliers in a normally open position.

5. The pliers of claim 2 wherein the ends of the first and second jaws have a 90° bend and have grooves therein to grasp ends of a hose clamp.

6. The pliers of claim 2 wherein grips are fitted over the first and second handles.

7. The pliers of claim 1 wherein the projection extends from a face of the one of the first and second members facing the other of the first and second members.

8. The pliers of claim 7 wherein the pivot area includes a first and second pivot notch on a side of the second member between the second jaw and the second handle, the pivot notches being positioned to receive the projection so that the jaws have two ranges of motion.

9. The pliers of claim 8 wherein the slot has an arcuate shape with a notch.

10. The pliers of claim 9 wherein the slot has two arcs with a notch between them so that when the projection is in the first pivot notch, the pin moves over one arc in the slot, and when the projection is in the second pivot notch, the pin moves over the second arc.

11. The pliers of claim 8 wherein the openings of the pivot notches are about 180° so that the projection is secured therein during use of the pliers.

12. The pliers of claim 8 wherein the pivot notches and the projection are located between the handles and the pin and slot.

13. The pliers of claim 8 wherein the jaws are curved inwardly so that they may grasp rounded objects.

14. The pliers of claim 8 wherein the first and second pivot notches are located between the jaws and the pin and slot thus giving a higher mechanical advantage than if the members pivoted at the pin.

15. The pliers of claim 14 wherein the slot is roughly triangular shaped so that the pin may move therein when the projection is moved from one pivot notch to another and when the handles are moved relative to one another.

16. The pliers of claim 15 wherein a spring clip is fit onto the member with the pivot notches to secure the projection therein.

* * * * *